US007704200B2

(12) United States Patent
Rahimi

(10) Patent No.: US 7,704,200 B2
(45) Date of Patent: Apr. 27, 2010

(54) EXERCISE APPARATUS, ESPECIALLY FOR EXERCISING OF THE BACK MUSCULATURE

(76) Inventor: Mehrdad Rahimi, Engelboldstrasse 70, Stuttgart (DE) 70569

( * ) Notice: Subject to any disclaimer, the term of this patent is extended or adjusted under 35 U.S.C. 154(b) by 0 days.

(21) Appl. No.: 12/168,640

(22) Filed: Jul. 7, 2008

(65) Prior Publication Data

US 2010/0004100 A1 Jan. 7, 2010

(30) Foreign Application Priority Data

Jul. 4, 2007 (DE) ..... 10 2007 032 148

(51) Int. Cl.
*A63B 23/02* (2006.01)
*A61H 1/02* (2006.01)

(52) U.S. Cl. ..... 482/142; 482/96; 482/143; 482/148; 482/907

(58) Field of Classification Search ..... 482/56, 482/95, 96, 142, 143, 148, 907; 606/240, 606/242–244; 128/845; 5/607–609, 613, 5/616–619, 621–624, 933, 934
See application file for complete search history.

(56) References Cited

U.S. PATENT DOCUMENTS

| | | | | | |
|---|---|---|---|---|---|
| 2,013,520 | A * | 9/1935 | McDermott | 482/56 |
| 2,109,775 | A * | 3/1938 | Hudson | 482/56 |
| 2,112,702 | A * | 3/1938 | Loibl | 5/600 |
| 2,208,502 | A * | 7/1940 | Kjelgaard | 606/245 |
| 2,332,184 | A * | 10/1943 | Sweeney | 601/26 |
| 2,532,425 | A * | 12/1950 | Schenker | 5/401 |
| 2,630,800 | A * | 3/1953 | Voss et al. | 606/244 |
| 4,722,328 | A * | 2/1988 | Scott et al. | 606/245 |
| 5,158,513 | A * | 10/1992 | Reeves | 482/56 |
| 6,319,213 | B1 * | 11/2001 | Tomac | 601/53 |
| 6,435,611 | B1 * | 8/2002 | Walter | 297/316 |
| 6,712,743 | B2 * | 3/2004 | Chen | 482/142 |
| 7,090,628 | B2 * | 8/2006 | Badarneh | 482/140 |
| 7,291,049 | B1 | 11/2007 | Davis et al. | |
| 7,601,103 | B2 * | 10/2009 | Chen et al. | 482/56 |
| 2007/0149373 | A1 * | 6/2007 | Dalebout et al. | 482/142 |

FOREIGN PATENT DOCUMENTS

| | | |
|---|---|---|
| DE | 9211486.5 | 8/1992 |
| DE | 29808996 | 5/1998 |
| DE | 29808996 U1 | 5/1998 |
| DE | 102005004074 | 1/2005 |
| DE | 102005004074 | 8/2006 |
| EP | 84106742.4 | 6/1984 |
| EP | 0131167 | 1/1985 |
| JP | 08117359 A * | 5/1996 |
| JP | 2004-329712 | 11/2004 |
| JP | 2004329712 | 11/2004 |
| WO | 2007/017282 | 2/2007 |
| WO | WO2007/017282 | 2/2007 |

* cited by examiner

*Primary Examiner*—Nicholas D Lucchesi
*Assistant Examiner*—Victor K Hwang
(74) *Attorney, Agent, or Firm*—Reising Ethington P.C.

(57) ABSTRACT

The invention concerns an exercise apparatus, especially for exercising the back musculature of a user (10) with a support surface (110) to accommodate the user (10) along the longitudinal axis (30). The reclining area (112) of the support surface (110) is largely formed by a number of transverse elements (120, 120*a*) arranged in succession on the longitudinal axis (30), which accommodates the user (10) preferably in the prone position, the transverse elements (120, 120*a*) being mounted to pivot around the longitudinal axis (30) to execute a see-saw movement.

22 Claims, 6 Drawing Sheets

EXERCISE APPARATUS, ESPECIALLY FOR EXERCISING OF THE BACK MUSCULATURE

BACKGROUND ART

1. Field of the Invention

The invention concerns an exercise apparatus. More particularly, the invention concerns an exercise apparatus for exercising the back musculature of the user.

2. Description of the Related Art

A variety of massage and exercise apparatuses are known in order to loosen and exercise the spinal area of a user. Thus, a device is described in Utility Model DE 91 09 569 U1 in which a user can execute strengthening exercises in a kneeling position. The user can place his hips and optionally also the thoracic spine on a cushioned, curved support surface. A device is known from DE 103 15 723 A1 in which the spinal column of the user can be twisted during use of the device in a countermovement.

The task of the invention is to devise a versatile and simple to operate exercise apparatus with which a user can loosen and exercise his back musculature.

The task is solved by the features of Claim 1. The additional claims concern advantageous embodiments of the invention.

SUMMARY OF THE INVENTION

An exercise apparatus is proposed, especially for exercising back musculature of the user with a support surface to accommodate the user along a longitudinal axis, in which a reclining area of the support surface is largely formed by a number of transverse elements arranged in succession on the longitudinal axis and which accommodates the user preferably in the prone position, the transverse elements being mounted to pivot around the longitudinal axis to execute a see-saw movement. The user advantageously experiences a loosening of his possibly tense back musculature along his spine by the see-saw movements and strengthening of this muscular by appropriate counter movements.

The exercise apparatus enables the user to distribute his body weight onto a number of surfaces. The back and hips are then largely relieved of body weight. The head and knee of the user are advantageously supported on separate supports. Advantageously the exercise apparatus can be used preventively or to relieve back complaints, for example, in disk prolapse, to treat the back for purposes of symmetric posture of the spin, as in massage bench for use by a masseuse, for exercising of the back and pelvic musculature by active movements by the user. The back musculature can be deliberately built up locally by moving the pelvis, for example, and/or the back and exercised, stretched and/or relieved.

The transverse elements can preferably be movable opposite each other around the longitudinal axis in see-saw movements. Effective loosening of the back musculature can occur on this account. At the same time exercise restricted deliberately to local areas of the spinal column is possible. By small see-saw movements that have an effect on the user, deeper lying areas of the musculature can be dealt with, which can be strengthened on this account. Individual transverse elements can be placed in movement in targeted fashion or individual transfer elements can be fixed in order to suppress their see-saw movement. All transverse elements of the reclining area can also be simultaneously moved, in which adjacent transverse elements are preferably oppositely rocked. If one transverse element is moved upward on one side, the next transverse element is moved downward on the same side and so forth.

A knee supporting part can advantageously be provided to accommodate one or both knees of the user, which is angled relative to the reclining area beneath the reclining area or can be angled. The user preferably kneels in the exercise apparatus while the upper body lies against the reclining area. The knee supporting part can preferably be designed separately movable for individual knees. Because of this the user can move his thighs like two pendulums or also produce a see-saw movement of a corresponding support for the hip by pushing down the knee.

Between the knee supporting part and the reclining area a linkage can be divided around which the reclining area can pivot relative to the knee supporting part around an axis across the longitudinal direction. Because of this it is possible that the reclining area in the unused condition can be pivoted into an upright position in order to assist the user in assuming the reclining position. The user, for example, can kneel into the knee supporting part and be fastened to the reclining area with appropriate fastening devices, whereupon the reclining area is brought into a reclining position with the user. The linkage can also be used to adjust a desired slope of the reclining area.

A head part can be provided that can be lowered relative to the reclining area. A suitable and comfortable reclining position for the user can be created on this account.

At least one transverse element can be moved in the direction of the longitudinal axis, the movement of the transverse element is along a seesaw axis and it can be deliberately shifted along the longitudinal axis. Because of this effects can be directed toward areas of the back or spinal column during exercise with the exercise apparatus and the apparatus simply adjusted to the measurements of the user.

Expediently a fastening device for the user can be provided on at least one transverse element, which serves to fasten the user to the reclining area. A belt, for example, can be provided as fastening device. A lateral support can also be provided as fastening device, optionally on both sides of a transverse element or on several transverse elements. A combination of lateral supports and belt is also conceivable. One skilled in the art will select appropriate fastening devices, depending on the application.

If at least one transverse element can have a bearing that is arranged beneath the transverse element, a favorable support for execution of the see-saw movements is obtained. Expediently, the transverse element so supported can be held with a frame that prevents excess deflection during the see-saw movement and stabilizing the reclining area overall.

The bearing can be arranged in the center beneath the transverse element. The bearing can advantageously include a spherical section on which the at least one transverse element is movable. It is also conceivable that the bearing can include a spring. The bearing can also include a ball bearing. The bearing can also include a pivot pin around which the corresponding transverse element can pivot.

As an alternative or in addition the at least one transverse element can be supported on both sides. In this case it is favorable, if up and down movement of the transverse element is possible on both sides of the transverse element.

It is also conceivable that at least one transverse element can have a bearing that is arranged above the transverse element. For this purpose the at least one transverse element can be provided on both sides with a suspension. In principle, different types of support can be combined with each other. Suspended transverse elements can also be combined with transverse elements supported underneath in an exercise apparatus. More variants are possible during exercise on this account. The transverse elements can be chosen, depending on the use conditions of the exercise apparatus.

To initiate the see-saw movement an electric drive can be provided in order to place at least one transverse element in a see-saw movement.

At least one of the transverse elements assigned to the reclining surface can be adjustable in its height relative to other transverse elements assigned to the reclining surface. Through this expedient local special effects can be produced, for example, a reduction in pressure loading of the user by the reclining area or also an increase in pressure loading by individual transverse elements to increase a massaging effect in the abdominal area. The reclining surface can preferably be configured tiltable relative to a horizontal. For this purpose the individual transverse elements can also be individually adjusted in height or the reclining area overall can be tilted relative to the horizontal.

A punch to act on the back of the user can be provided above the reclining surface in which the punch can be moved along the reclining area and/or perpendicular to the reclining area. A massage movement can be executed with the punch locally, for example, comparable to an acupressor, or a rolling movement or stretching movement along the back. A device can also be provided in order to temper the back, for example, to expose it to heat or cold.

BRIEF DESCRIPTION OF THE DRAWINGS

The invention is further explained by means of practical examples. In this case.

The same or equivalent elements are numbered with the same reference numbers in the figures.

DETAILED DESCRIPTION OF THE PREFERRED EMBODIMENT(S)

Figure 1:
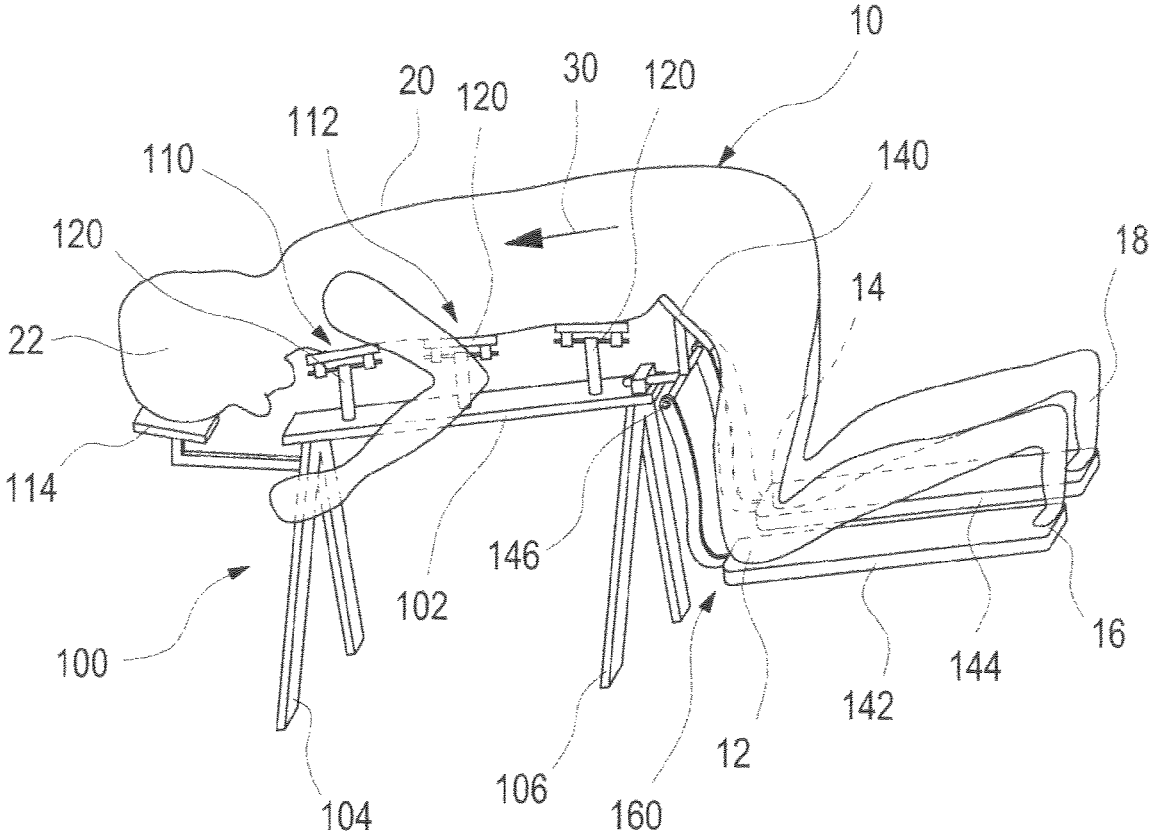
FIG. 1 schematically depicts a first preferred embodiment of an exercise apparatus in the training state with the transverse elements mounted on the bottom.
Figure 2:
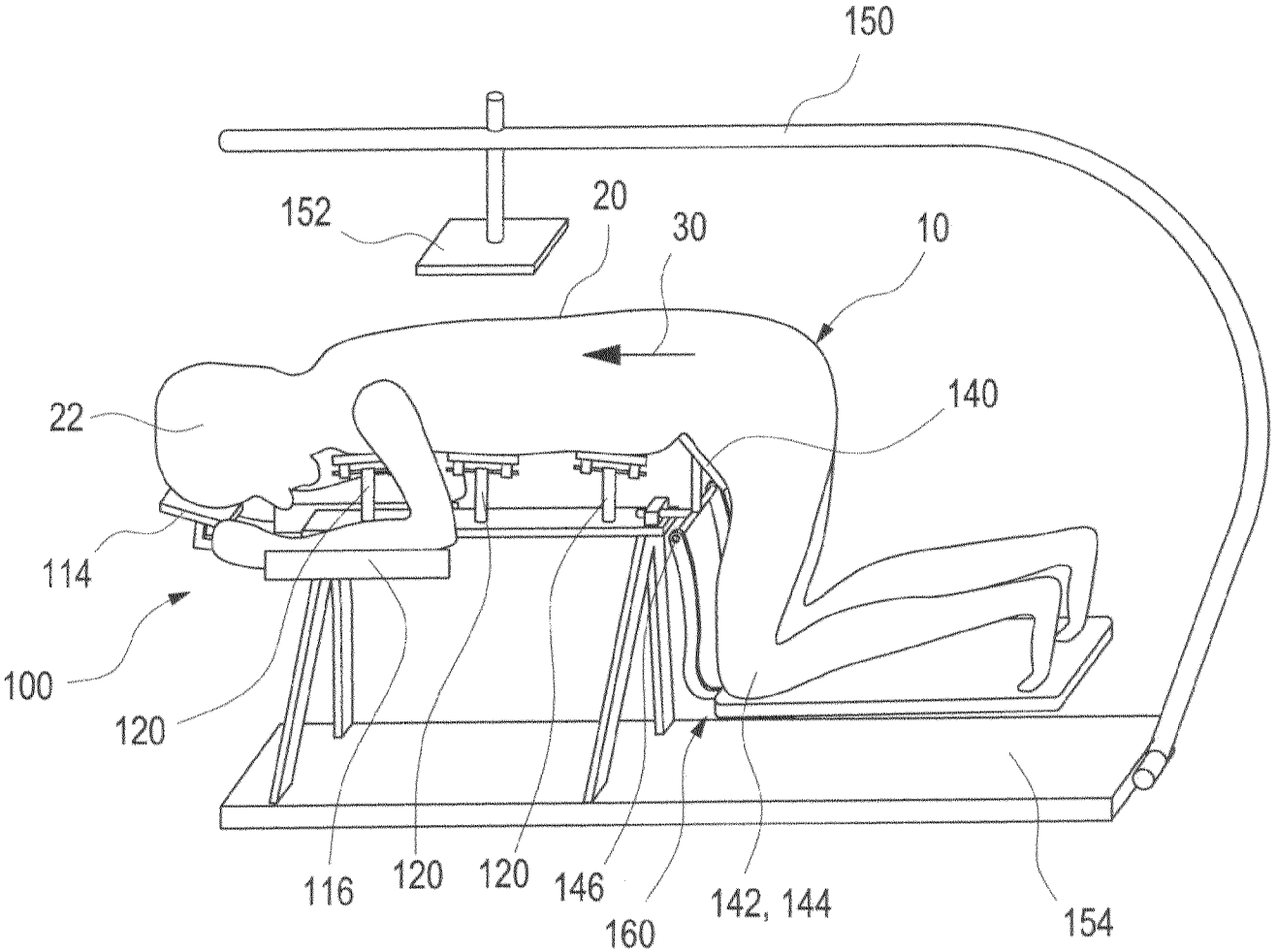
FIG. 2 shows a second preferred embodiment of an exercise apparatus in the training state with a device to act upon the back of the user with pressure.
Figure 3:
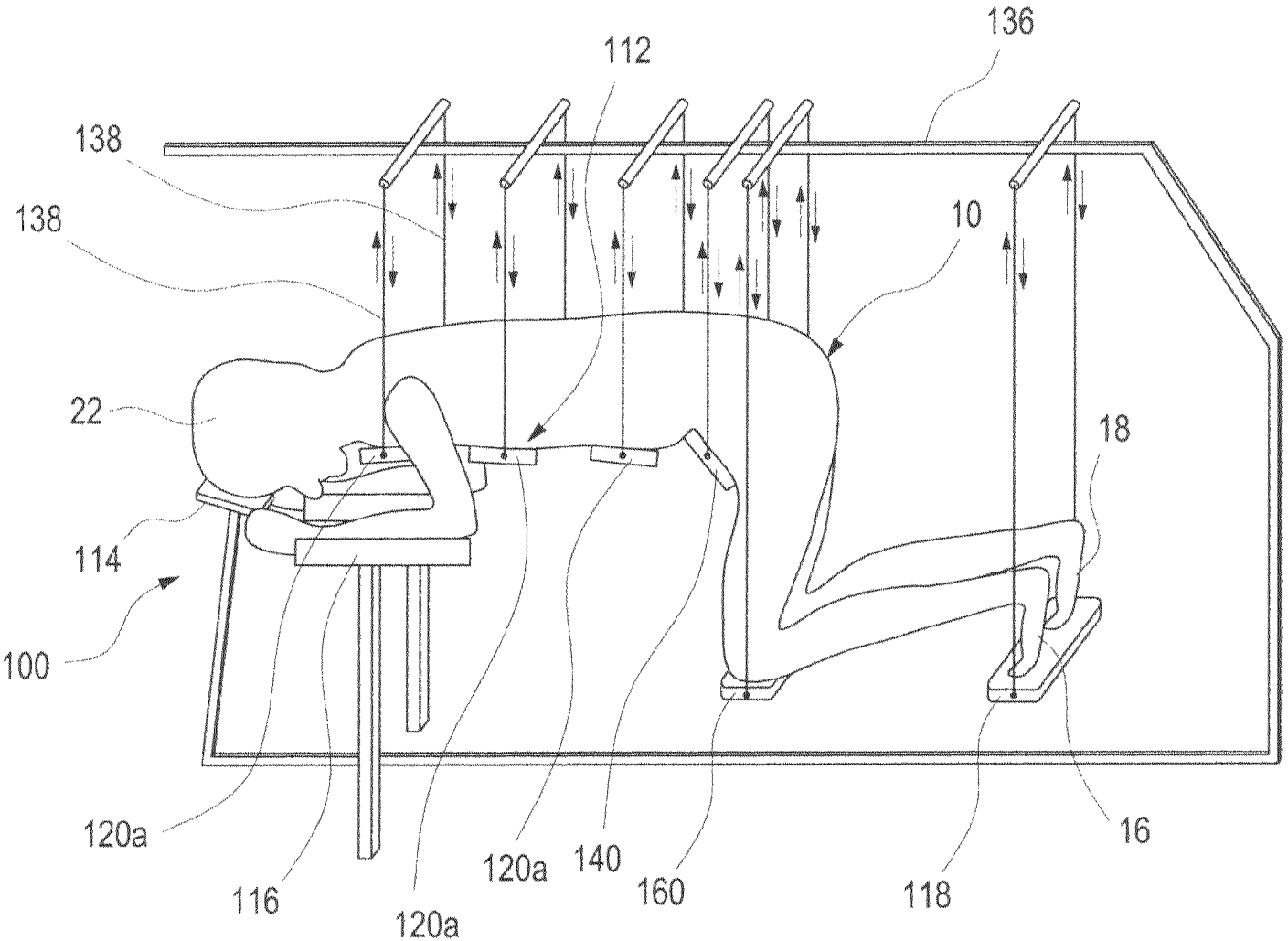
FIG. 3 shows a third preferred embodiment of an exercise apparatus in the training state with suspended support.

FIGS. 1 to 3 illustrate different preferred variants of an exercise apparatus 100 that serves to train the back musculature of a user 10 in order to explain the invention. The user lies in the prone position on a reclining area 112 of a support surface 110 so that his back 20 faces up and is freely accessible, for example, to a masseuse or a device, for example, a heat radiator.

FIG. 1 represents a first preferred embodiment of the exercise apparatus 100 according to the invention. The reclining area 112 extends along longitudinal axis 30. The reclining area 112 is formed by a number of transverse elements 120 arranged on the longitudinal axis 30 in succession, the transverse elements 120 being mounted to pivot around the longitudinal axis 30 to execute a see-saw movement. To support the head 22 of the user a separate head part 114 is provided, which is preferably not designed as a see-saw but instead is mounted rigidly. The head part 114 can be changed in its slope and height in order to accommodate different head sizes of users 10 and permit a comfortable head holding. At least three transverse elements 120 are preferably provided in reclining area 112, which can execute opposite see-saw movements.

The transverse elements 112 [sic:120] are fastened to a support part 102, which is supported with connectors 104, 106 on the floor.

While the user 10 with his upper body lies essentially flat on the reclining area 112, his knees 12, 14 and feet 16, 18 are angled downward, the pelvis being supported by a pelvis transverse element 140 on which two pedal-like knee supports 142, 144 engage forming a knee supporting part 160. A linkage 146 permits movements of the knee supporting part 160 and the pedal-like knee supports 142, 144. The user 10 can then alternately move his knees 12, 14 downward and produce a see-saw movement of the hip-transverse element 140. The linkage 146, however, can also be configured so that the user 10 can execute a movement similar to that on a bicycle and perform circular movements with knees 12, 14.

The user 10 can activate individual transverse elements 120 by deliberate shifting of the weight, for example, the shoulders and place them in a see-saw movement. Thus, one shoulder can be moved downward, while the other shoulder is moved upward corresponding to the see-saw movement. Optionally one or more transverse elements 120 can be placed in motion by a mechanical drive, for example, electric motor or by another person, for example, a masseuse or a therapist. The transverse elements 120 are preferably wide enough so that they can reliably accommodate the width of the user but relatively narrow in order to be able to achieve a local effect of the see-saw movement.

The height of individual transverse elements 120 and the spacing of the transverse elements 120 relative to each other can be adjusted separately in order to achieve good adaptation to the measurements of the user 10. A slope of the reclining area 112 can also be varied so that the head 22 can be positioned lower or higher than in a horizontal position with the back 22 of the user 10 straight.

Naturally all transverse elements 120, 140 can have a shape adapted to the body and be corresponding cushioned in order to permit comfortable reclining.

FIG. 2 shows another preferred embodiment of the exercise apparatus 100. To describe the essential elements that are present in both embodiments, the description in FIG. 1 is referred to so as to avoid needless repetition. In this embodiment it is prescribed that a clamp 150 can be brought over the back 20 of the user 10 on which different devices can be mounted above the support area 110 and above the user 10 in the exercise position. Thus, a punch 152 can be provided, which travels along the back 20 and massages it. A heating device can also be provided, for example, which heats the back 20 by radiation or which can be placed on the back 20 like a heat cushion. An additional arm support 116 is also provided for the user 10, on which he can place his arms on both sides of the reclining area 112.

The clamp 150 is articulated with a bottom 154 so that the clamp 150 can be pivoted out when it is not needed or so that the user 10 is not hampered in getting on or getting off the exercise apparatus 100.

Another preferred embodiment of the exercise apparatus 100 is apparent in FIG. 3. In contrast to the two embodiments just described, in this embodiment transverse elements 120*a* of a reclining area 112 are arranged suspended, suspensions 138 being mounted on the transverse elements 120*a* on both sides. The suspension 138 are connected to a mount 136 and positioned here so that the individual transverse elements 120*a* can execute see-saw movements.

The user 10 lies with his upper body with the back 20 up on transverse elements 120*a* while his head 22 lies on a stable head part 114. His knees are positioned on a knee supporting part 160, which is arranged beneath the reclining area 112. His feet are supported on a foot part 118.

Figure 4A:
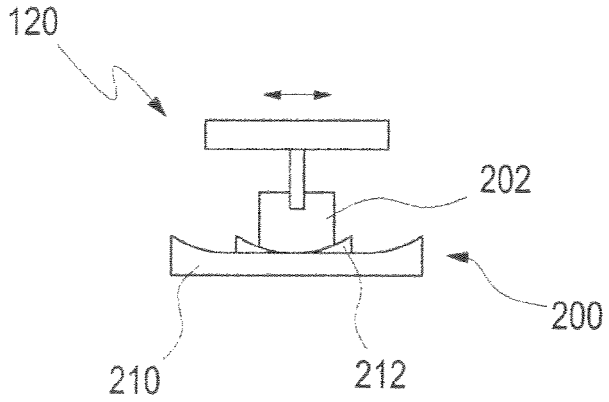
FIG. 4*a, b* shows different embodiments of a support of transverse elements with a displacement possibility along a longitudinal axis.
Figure 4B:
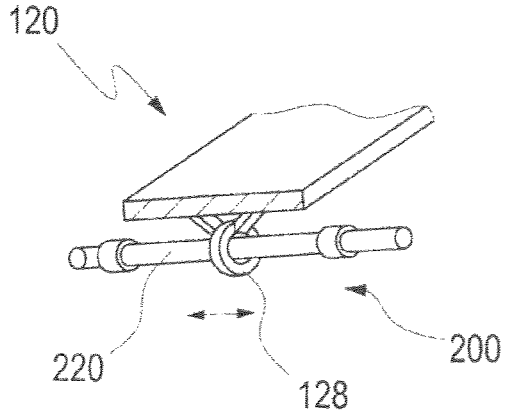

Details concerning transverse elements 120 are shown in FIGS. 4*a* and 4*b*, as can be used in the practical examples of FIGS. 1 and 2 with support of the bottom. The direction of the longitudinal axis 30 (FIG. 1, FIG. 2) lies in the plane of the image.

The transverse element 120 is movable in the longitudinal direction, the transverse element 120 being supported on a support surface 210 with bottom bearings 200. A bearing block 202 to which the transverse element 120 is linked, is mounted to move back and forth on a sliding surface 212 in the direction of longitudinal axis 30. FIG. 4*b* shows a variant in which the bearing 200 includes a sliding ring 128 and a pivot 220 on which the transverse element 120 can be pushed. It is possible that displacement of transverse elements 120 occurs during the see-saw movement in order to control the effect of the see-saw movement.

Figure 5:
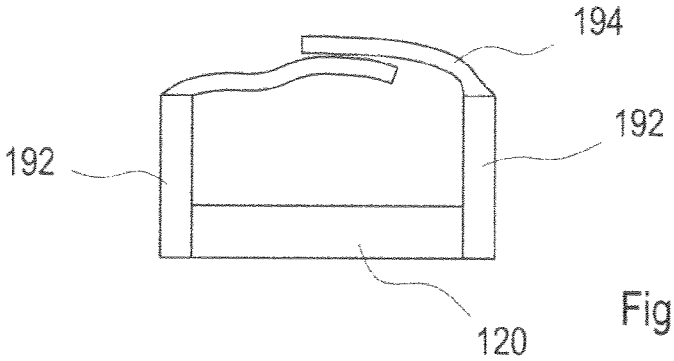
FIG. 5 shows fastening elements for a user.

FIG. 5 shows a transverse element 120 with fastening devices 192, 194 which fasten a user in the exercise state and secure him. On both sides on the narrow sides of transverse element 120 a fastening device 192 designed as a lateral support is provided on whose free ends belt parts of a fastening 194 designed as a belt are fastened. A user can therefore be attached to the transverse element 120 and at the same time experience lateral support which stabilized him during the see-saw movements of transverse elements 120.

A number of different support embodiments of the transverse element 120 are shown in FIGS. 6*a* to 6*g*, which are mounted on a bottom 122 with the transverse element 120 in the center through a bearing 200. The transverse element 120 has a width B that is greater than its length L in the longitudinal direction 30. Two supports 124 are arranged opposite each other on the bottom 122 on both broad sides in the longitudinal direction 30 (FIG. 6*a*), each of which end in an eye 126. A rod 134 engages through both eyes 126 so that the transverse element 120 can pivot around rod 134 but is supported stably in the direction of the rod longitudinal axis. A support 130 engages rod 134 in the bottom and fastens it with an eye 132.

Figure 6A:
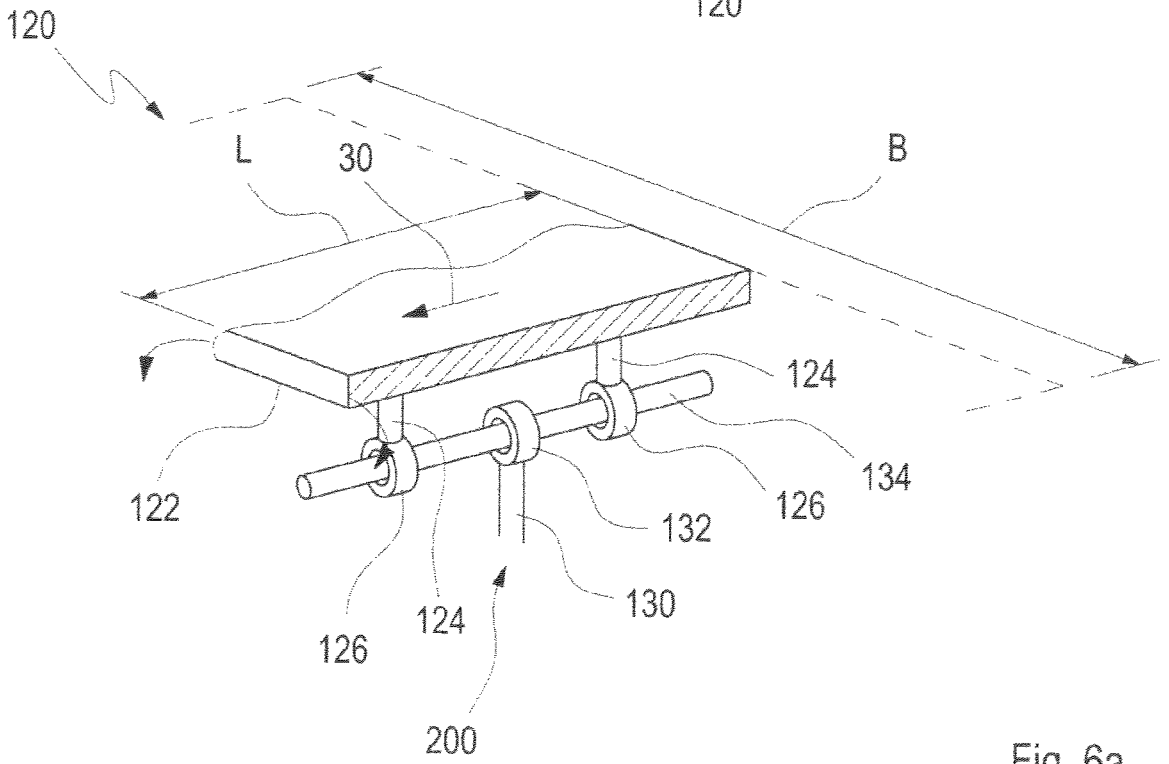
FIG. 6*a-g* shows different preferred bearing capabilities of the transverse elements and FIG. 7*a, b* shows alternative bearing and drive capabilities of the transverse elements.
Figure 6B:
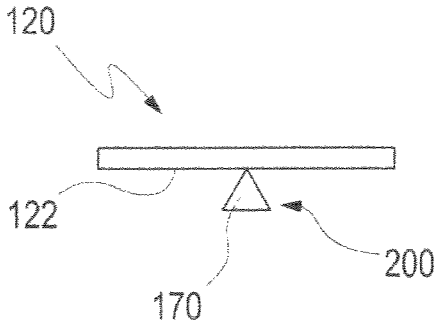
Figure 6C:
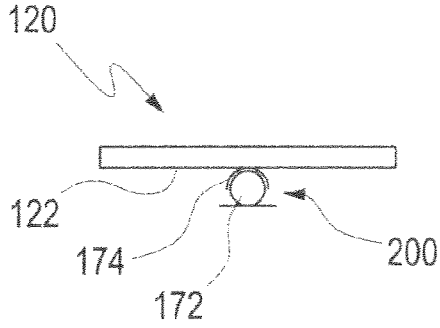

FIGS. 6*b* and 6*c* show a support on a bearing 200 which is especially suitable for see-saw movements because of its shape. The bearing in FIG. 6*b* is formed by a wedge 170, which tapers toward the bottom 122 of transverse element 120. A bearing 200 with a ball or a ball section 172 is apparent in FIG. 6*c*, in which a ball mount 174 is arranged on the bottom 122 of transverse element 120, which can slide on the surface of the ball section 172.

Figure 6D:
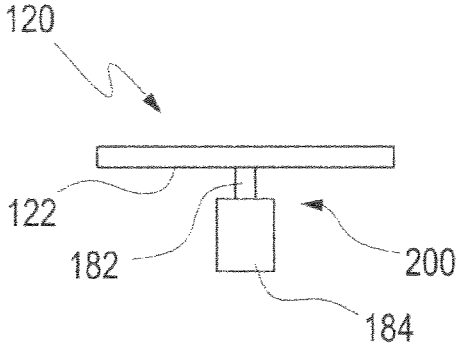
Figure 6E:
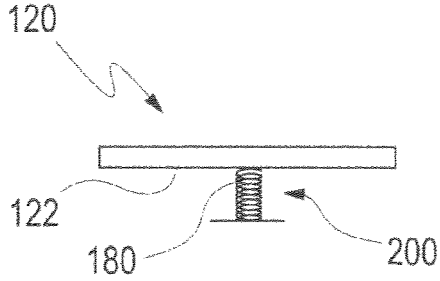
Figure 6F:
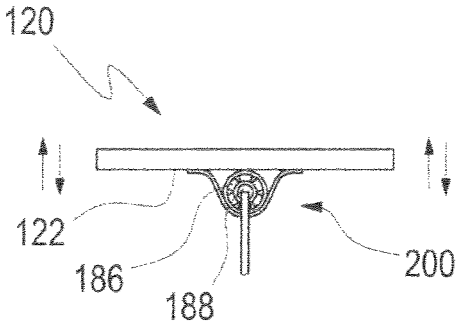
Figure 6G:
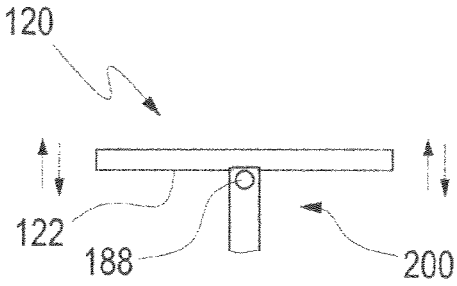
Figure 7A:
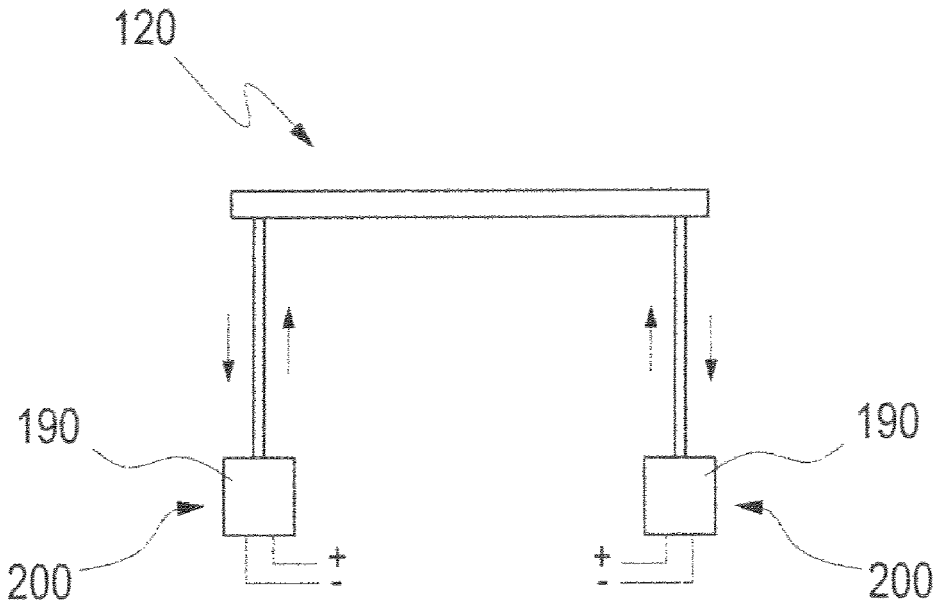
Figure 7B:
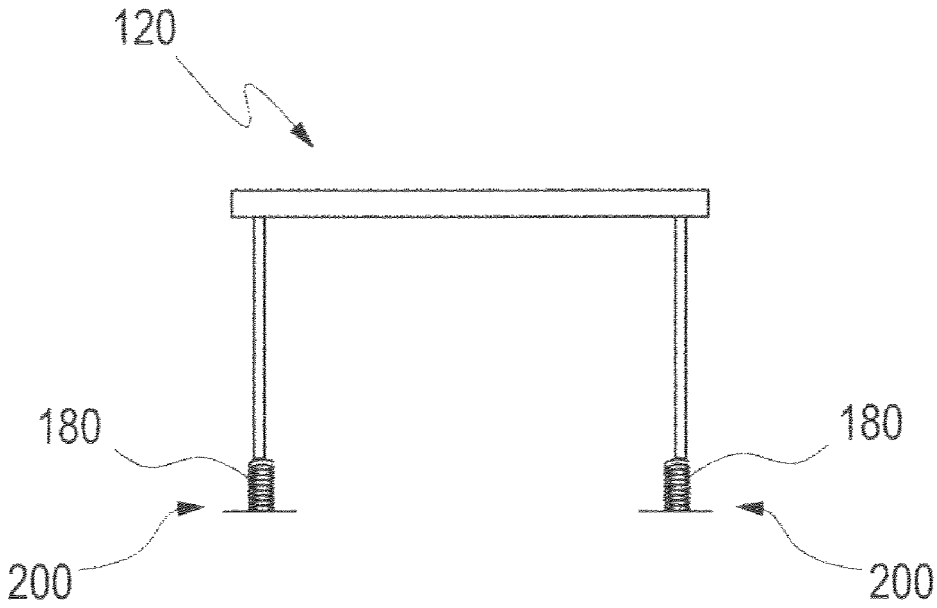

FIGS. 6*d* and 6*e* show embodiments in which the bearing 200 includes a rubber bearing 182 arranged between the transverse element 120 and a bearing block 184 (FIG. 6*d*) or a spring 180, for example, a compression spring (FIG. 6*e*).

The invention claimed is:

1. An exercise apparatus, especially for exercising of the back musculature of a user (10) defining a longitudinal axis (30), said exercise apparatus comprising:

a support surface (110) to accommodate the user (10) along the longitudinal axis (30), said support surface (110) including a reclining area (112) largely formed by a plurality of transverse elements (120, 120*a*) arranged in succession on along the longitudinal axis (30), to accommodate the user (10) preferably in a prone, kneeling position, each of the transverse elements (120, 120*a*) being mounted to pivot around the longitudinal axis (30) to execute a see-saw movement; and a knee support part (160) to accommodate knees (12, 14) of the user (10), said knee support part (160) angled relative to said reclining area (112) and mounted to pivot around the longitudinal axis (30), wherein said knee support part (160) includes two knee supports (142, 144) movable independently of each other for the knees (12, 14) of the user (10), each of the knee supports (142, 144) accommodating one of the knees (12, 14) of the user (10), and wherein the knee support part (160) is positioned relative to the support surface (110) to orient the user (10) in a prone, kneeling position with their upper body supported by the reclining area (112) and their knees (12, 14) supported by the knee support part (160).

2. An exercise apparatus according to claim 1, characterized in that said transverse elements (120, 120*a*) are movable opposite each other in see-saw movements around longitudinal axis (30).

3. An exercise apparatus according to claim 1 including a linkage (146) between the knee support part (160) and the reclining area (112) pivotable relative to said knee part (160) around an axis across the longitudinal direction (30).

4. An exercise apparatus according to claim 1, including a head part (114) movable relative to the reclining area (112).

5. An exercise apparatus according to claim 1, characterized in that at least one of said transverse elements (120, 120*a*) can be moved in the direction of longitudinal axis (30).

6. An exercise apparatus according to claim 1, characterized in that a fastening device (192, 194) for the user (10) is provided on at least one of said transverse elements (120, 120*a*) to hold the user (10) on the reclining area (112).

7. Exercise apparatus according to claim 6, wherein said fastening device (192) includes a belt.

8. An exercise apparatus according to claim 6, wherein said fastening device (194) includes a lateral support.

9. An exercise apparatus according to claim 1, characterized in that at least one of said transverse elements (120) has a bearing (200) which is arranged beneath the transverse element (120, 120*a*).

10. An exercise apparatus according to claim 9, characterized in that said beating (200) is arranged in the center beneath said transverse element (120).

11. An exercise apparatus according to claim 9, characterized in that said bearing (200) includes a spherical section (172) on which the at least one of said transverse elements (120) is movable.

12. An exercise apparatus according to claim 9, characterized in that said bearing (200) includes a spring (180).

13. An exercise apparatus according to claim 12, characterized in that said bearing (200) includes a ball bearing (186).

14. An exercise apparatus according to claim 13, characterized in that said bearing (200) includes a pivot (188).

15. An exercise apparatus according to claim 1, characterized in that at least one of said transverse elements (120) is supported on both sides.

16. An exercise apparatus according to claim 1, characterized in that at least one of said transverse elements (120*a*) has a bearing (200) that is arranged above the transverse elements (120, 120*a*).

17. An exercise apparatus according to claim 1, characterized in that at least one of said transverse elements (120*a*) is provided on both sides with a suspension (138).

18. An exercise apparatus according to claim 1, including an electric drive (190) for moving at least one of said transverse elements (120, 120*a*) in a see-saw movement.

19. An exercise apparatus according to claim 1, characterized in that at least one of said transverse elements (120, 120*a*) assigned to the reclining surface (112) is adjustable in its height relative to other of said transverse elements (120, 120*a*) assigned to the reclining surface (112).

20. An exercise apparatus according to claim 1, characterized in that a device to expose the back (20) of the user (10) to pressure and/or heat is provided above the reclining surface (112).

21. An exercise apparatus according to claim 20, characterized in that a punch (152) can be moved along the reclining area (112) and/or perpendicular to the reclining area (112).

22. An exercise apparatus according to claim 1, characterized in that the reclining surface (112) is configured tiltable relative to a horizontal.

* * * * *